US007647908B1

(12) United States Patent
Biondo et al.

(10) Patent No.: US 7,647,908 B1
(45) Date of Patent: Jan. 19, 2010

(54) METHODS AND SYSTEMS FOR REMOTELY STARTING ENGINES OF VEHICLES WITH BI-DIRECTIONAL CONTROL

(75) Inventors: William A. Biondo, Beverly Hills, MI (US); Clark E. McCall, Ann Arbor, MI (US); David T. Proefke, Madison Heights, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 12/271,587

(22) Filed: Nov. 14, 2008

(51) Int. Cl.
*F02N 11/12* (2006.01)
*F02D 28/00* (2006.01)

(52) U.S. Cl. ..... 123/179.2; 701/113

(58) Field of Classification Search ..... 123/179.2; 701/113
See application file for complete search history.

(56) References Cited

U.S. PATENT DOCUMENTS 5,990,800 A * 11/1999 Tamaki et al. ..... 340/679
6,561,151 B1 * 5/2003 Wisnia et al. ..... 123/179.2
7,258,092 B2 * 8/2007 Beaucaire et al. ..... 123/142.5 E

* cited by examiner

*Primary Examiner*—Hai H Huynh
(74) *Attorney, Agent, or Firm*—Ingrassia Fisher & Lorenz, P.C.

(57) ABSTRACT

A method for remotely starting an engine of a vehicle includes the steps of assessing a state of charge of the vehicle battery, providing a first type of remote start request to the vehicle if the state of charge of the vehicle battery is greater than a predetermined threshold, and providing a second type of remote start request to the vehicle if the state of charge of the vehicle battery is less than or equal to the predetermined threshold.

20 Claims, 2 Drawing Sheets

METHODS AND SYSTEMS FOR REMOTELY STARTING ENGINES OF VEHICLES WITH BI-DIRECTIONAL CONTROL

TECHNICAL FIELD

The present invention generally relates to the field of vehicles and, more specifically, to methods and systems for remotely starting engines of vehicles.

BACKGROUND OF THE INVENTION

Certain vehicles today include remote start systems and algorithms that enable a user of the vehicle to remotely start an engine of the vehicle. Such a remote start of the engine may be desired, for example, if the user wishes to have the vehicle's interior heated or cooled before the user enters the vehicle. However, in certain situations it may be difficult to remotely start the engine of the vehicle, for example, if a battery of the vehicle has a low state of charge. In addition, it may be difficult to remotely start the engine of the vehicle if the user of the vehicle is positioned too far from the vehicle.

Accordingly, it is desirable to provide an improved method for remotely starting an engine of the vehicle, for example when a battery of the vehicle has a low state of charge or when the user is positioned too far from the vehicle. It is also desirable to provide an improved program product for such remote starting of an engine of a vehicle. It is further desirable to provide an improved system for such remote starting of an engine of a vehicle. Furthermore, other desirable features and characteristics of the present invention will be apparent from the subsequent detailed description and the appended claims, taken in conjunction with the accompanying drawings and the foregoing technical field and background.

SUMMARY OF THE INVENTION

In accordance with an exemplary embodiment of the present invention, a method for remotely starting an engine of a vehicle, the vehicle including a battery, is provided. The method comprises the steps of assessing a state of charge of the battery, providing a first type of remote start request to the vehicle if the state of charge of the battery is greater than a first predetermined threshold, and providing a second type of remote start request to the vehicle if the state of charge of the battery is less than or equal to the first predetermined threshold.

In accordance with another exemplary embodiment of the present invention, a program product for remotely starting an engine of a vehicle, the vehicle including a battery, is provided. The program product comprises a program and a computer-readable signal bearing media. The program is configured to at least facilitate assessing a state of charge of the battery, providing a first type of remote start request to the vehicle if the state of charge of the battery is greater than a first predetermined threshold, and providing a second type of remote start request to the vehicle if the state of charge of the battery is less than or equal to the first predetermined threshold. The computer-readable signal bearing media bears the program.

In accordance with a further exemplary embodiment of the present invention, a system for remotely starting an engine of a vehicle, the vehicle including a battery, is provided. The system comprises a processor and a transmitter. The processor is configured to at least facilitate assessing a state of charge of the battery. The transmitter is coupled to the processor, and is configured to at least facilitate providing a first type of remote start request to the vehicle if the state of charge of the battery is greater than a first predetermined threshold, and providing a second type of remote start request to the vehicle if the state of charge of the battery is less than or equal to the first predetermined threshold.

BRIEF DESCRIPTION OF THE DRAWINGS

The present invention will hereinafter be described in conjunction with the following drawing figures, wherein like numerals denote like elements, and wherein.

DETAILED DESCRIPTION OF THE INVENTION

The following detailed description is merely exemplary in nature, and is not intended to limit the invention or the application and uses of the invention. Furthermore, there is no intention to be bound by any expressed or implied theory presented in the preceding technical field, background, brief summary or the following detailed description.

Figure 1:
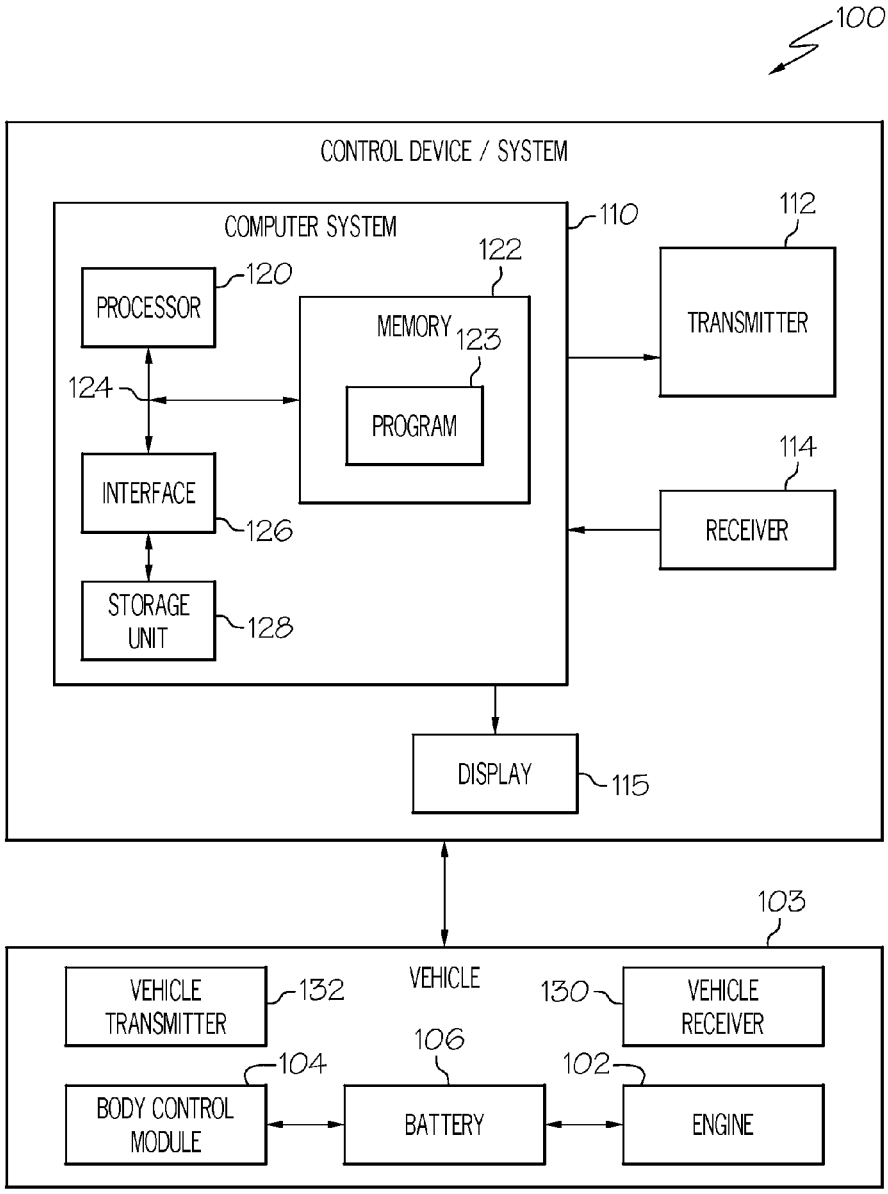
FIG. 1 is a functional block diagram of a control system for remotely starting an engine of a vehicle, in accordance with an exemplary embodiment of the present invention.

FIG. 1 is a functional block diagram of a control system 100 for remotely starting an engine 102 of a vehicle 103, in accordance with an exemplary embodiment of the present invention. As shown in FIG. 1, the vehicle 103 preferably also includes a body control module 104 that at least facilitates starting the engine 102 via energy from a battery 106. Additionally, the vehicle 103 includes a vehicle receiver 130 for receiving engine remote start signals and requests from the control system 100 and a vehicle transmitter 132 for transmitting information to the control system 100 for use thereby. In certain preferred embodiments, the vehicle 103 comprises an automobile such as a sedan, a truck, a van, a sport utility vehicle, or another type of automobile. However, in various embodiments, the control system 100 can be used in connection with any number of types of vehicles and/or systems thereof.

As depicted in FIG. 1, the control system 100 comprises a computer system 110, a transmitter 112, a receiver 114, and a display 115. Specifically, in one preferred embodiment, the control system 100 comprises a key fob unit or similar device that includes a computer system 110, a transmitter 112, a receiver 114, and a display 115 of FIG. 1.

The computer system 110 is configured to at least facilitate receiving a remote start request, assessing a state of charge of the vehicle battery 106 based at least in part upon information obtained from the vehicle 103 via vehicle transmitter 132 and the receiver 114, and providing, in response thereto, instructions for the transmitter 112 to transmit a specified sequence of engine start requests to remotely start the engine 102 of the vehicle 103. In a preferred embodiment, the computer system 110 is further configured to at least facilitate determining a measure of strength of response signals provided by the vehicle 103 to the receiver 114, among other values, and providing, based at least in part thereon, specified instructions to the display 115 for displaying one or more notices or requests for a user of the vehicle 103.

In the embodiment depicted in FIG. 1, the computer system 110 includes a processor 120, a memory 122, a computer bus 124, an interface 126, and a storage device 128. The processor 120 determines whether a remote start request has been received from a user of the vehicle 103, determines a state of charge of the vehicle battery 106 and a measure of the radio frequency (RF) signal strength of a response signal from the vehicle 103 (preferably from a signal provided by the receiver 114 described further below), provides instructions to the transmitter 112 for sending engine start signals to remotely start the engine 102 of the vehicle 103, provides instructions to the display 115 for displaying one or more notices or requests for a user of the vehicle 103, and performs the computation and control functions of the computer system 110 or portions thereof. The processor 120 may comprise any type of processor or multiple processors, single integrated circuits such as a microprocessor, or any suitable number of integrated circuit devices and/or circuit boards working in cooperation to accomplish the functions of a processing unit. During operation, the processor 120 executes one or more programs 123 preferably stored within the memory 122 and, as such, controls the general operation of the computer system 110.

As referenced above, the memory 122 stores a program or programs 123 that execute one or more embodiments of processes such as the process 200 described below in connection with FIG. 2 and/or various steps thereof and/or other processes, such as those described elsewhere herein. The memory 122 can be any type of suitable memory. This would include various types of dynamic random access memory (DRAM) such as SDRAM, various types of static RAM (SRAM), and various types of non-volatile memory (PROM, EPROM, and flash). It should be understood that the memory 122 may be a single type of memory component, or it may be composed of many different types of memory components. In addition, the memory 122 and the processor 120 may be distributed across several different computers that collectively comprise the computer system 110. For example, a portion of the memory 122 may reside on a computer within a particular apparatus or process, and another portion may reside on a remote computer.

The computer bus 124 serves to transmit programs, data, status, and other information or signals between the various components of the computer system 110. The computer bus 124 can be any suitable physical or logical means of connecting computer systems and components. This includes, but is not limited to, direct hard-wired connections, fiber optics, and infrared and wireless bus technologies.

The interface 126 allows communication to the computer system 110, for example from a vehicle user, a system operator, and/or another computer system, and can be implemented using any suitable method and apparatus. In a preferred embodiment, the interface 126 receives a remote start request from a user of the vehicle 103 desiring to remotely start the vehicle 103, and provides a signal representative thereof to the processor 120 for processing in accordance with the steps of the process 200 described further below in connection with FIG. 2.

The storage device 128 can be any suitable type of storage apparatus, including direct access storage devices such as hard disk drives, flash systems, floppy disk drives and optical disk drives. In one exemplary embodiment, the storage device 128 is a program product from which memory 122 can receive a program 123 that executes one or more embodiments of the process 200 of FIG. 2 and/or steps thereof as described in greater detail further below. In one preferred embodiment, such a program product can be implemented as part of, inserted into, or otherwise coupled to the control system 100. As one exemplary implementation, the computer system 110 may also utilize an Internet website, for example for providing or maintaining data or performing operations thereon.

It will be appreciated that while this exemplary embodiment is described in the context of a fully functioning computer system, those skilled in the art will recognize that the mechanisms of the present invention are capable of being distributed as a program product in a variety of forms, and that the present invention applies equally regardless of the particular type of computer-readable signal bearing media used to carry out the distribution. Examples of signal bearing media include: recordable media such as floppy disks, hard drives, memory cards and optical disks, and transmission media such as digital and analog communication links. It will similarly be appreciated that the computer system 110 may also otherwise differ from the embodiment depicted in FIG. 1, for example in that the computer system 110 may be coupled to or may otherwise utilize one or more remote computer systems and/or other control systems.

The transmitter 112 is coupled to the computer system 110 and to the vehicle 103. The transmitter 112 receives instructions from the processor 120 of the computer system 110. In response to the instructions, the transmitter 112 transmits a first type of remote start request to the vehicle 103 if the state of charge of the vehicle battery 106 is greater than a first predetermined threshold, and a second type of remote start request to the vehicle 103 if the state of charge of the vehicle battery is less than or equal to the first predetermined threshold.

Specifically, in accordance with a preferred embodiment, the transmitter 112 is configured to at least facilitate transmitting (a) a first group of engine start signals to the vehicle if the state of charge of the vehicle battery is greater than the first predetermined threshold and (b) a second group of engine start signals to the vehicle if the state of charge of the vehicle battery is less than or equal to the first predetermined threshold, with each of the first group of engine start signals having a first power level and each of the second group of engine start signals having a second power level that is less than the first power level. In addition, the transmitter 112 is preferably further configured to transmit a state of charge request to the vehicle 103 requesting that a state of charge response signal be sent to the receiver 114 for processing by the processor 120 and use by the processor 120 in providing the instructions to the transmitter 112 as to the transmission of engine start signals to the vehicle 103. In an additional embodiment, the state of charge of the vehicle battery is communicated as a normal response to the transmitted remote start request.

The receiver 114 is coupled to the computer system 110 and to the vehicle 103. The receiver 114 receives a state of charge response signal from the vehicle 103 in response to the state of charge request provided by the transmitter 112. The receiver 114 also provides a signal or other indication to the processor 120 representative of the state of charge response signal so that the processor 120 can determine the RF signal strength of the state of charge response signal and provide appropriate instructions, based at least in part thereon, to the transmitter 112 for transmission of specified engine start signals to the vehicle 103 to remotely start the engine 102 of the vehicle 103.

The display 115 is coupled to the computer system 110, and specifically to the processor 120 thereof. The display 115 is configured to at least facilitate displaying a first notification of a lack of response from the vehicle 103 if no state of charge response signal is detected, based upon instructions provided by the processor 120. The display 115 is further configured to at least facilitate displaying a second notification for a user of the vehicle 103 to move closer to the vehicle 103 if the measure of RF signal strength of the state of charge response signal is less than or equal to a second predetermined threshold.

Figure 2:
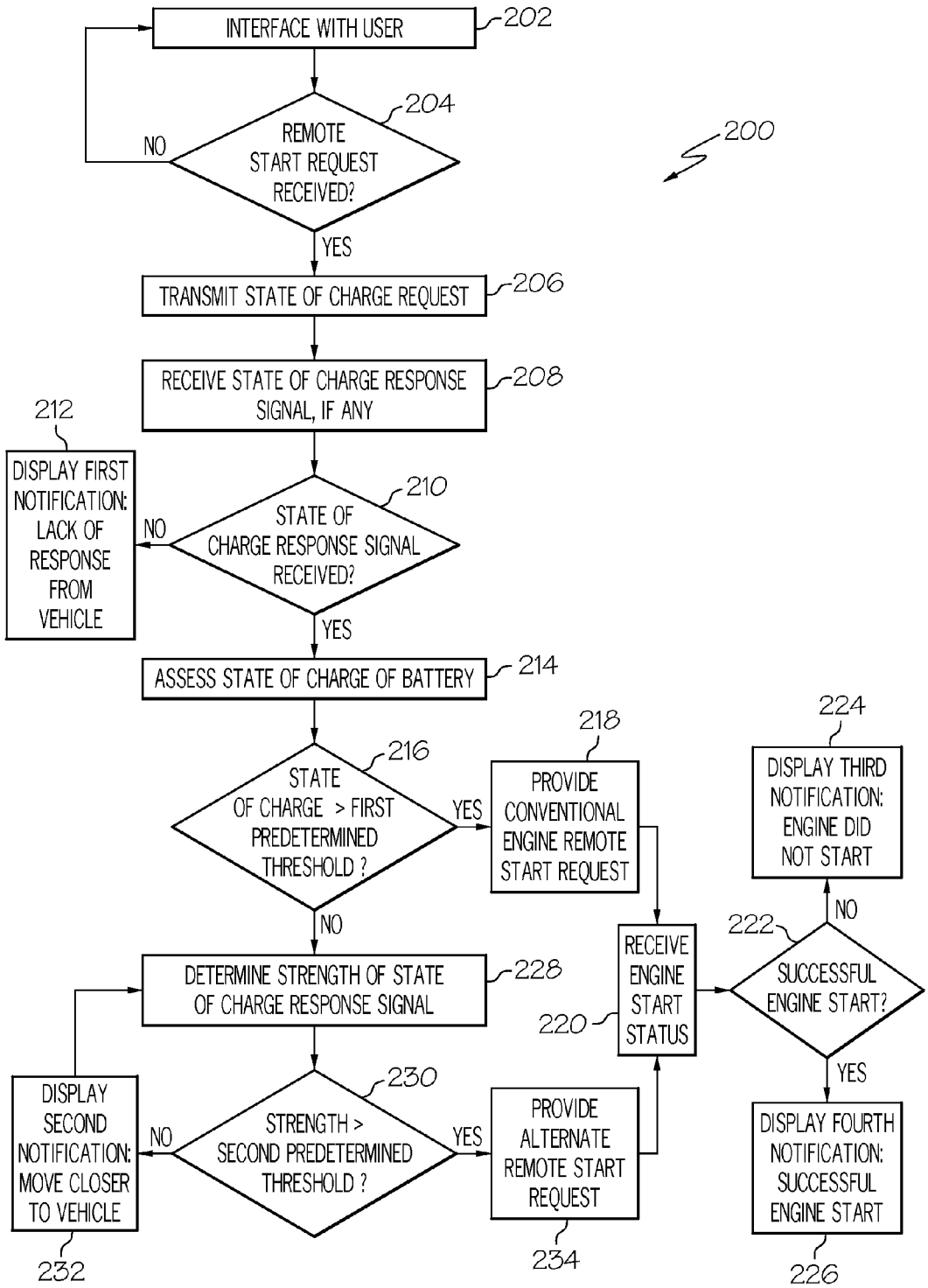
FIG. 2 is a flowchart of a process for remotely starting an engine of a vehicle that can be implemented in connection with the control system of FIG. 1, in accordance with an exemplary embodiment of the present invention.

FIG. 2 is a flowchart of a process 200 for remotely starting an engine of a vehicle, in accordance with an exemplary embodiment of the present invention. In a preferred embodiment, the process 200 can be implemented in connection with the control system 100 of FIG. 1 and/or through program products that can be utilized in connection therewith in remotely starting an engine of a vehicle, such as the engine 102 of the vehicle 103 of FIG. 1. However, it will be appreciated that in various embodiments the process 200 may also be utilized in connection with any number of different types of systems and/or other devices.

As depicted in FIG. 2, the process 200 includes the step of receiving a remote start request from a user (step 202). The computer system 110 of FIG. 1 interfaces with a user of the vehicle 103 of FIG. 1 via the interface 126 of the computer system 110 to receive the remote start request. In one exemplary embodiment, the computer system 110 receives remote start requests from the user to start the engine 102 of the vehicle 103 of FIG. 1 before the user enters the vehicle. In another exemplary embodiment, such a remote start request can be received from the user after the user enters the vehicle, for example if the battery 106 of the vehicle 103 of FIG. 1 has a low state of charge and the user is unable to start the engine 102 manually with an ignition key (not depicted in FIG. 1). In a preferred embodiment, the user provides the remote start request by pressing a button on a key fob of or otherwise manipulating the control system 100 of FIG. 1.

A determination is then made as to whether a remote start request has been received (step 204). In a preferred embodiment, this determination is made by the processor 120 of FIG. 1 as to whether the interface 126 of FIG. 1 has received a request from the user to remotely start the engine 102 of the vehicle 103.

If it is determined in step 204 that no remote start request has been received, then the process returns to step 202. Steps 202 and 204 then repeat until a determination is made in a subsequent iteration of step 204 that a remote start request has been received.

Once a determination is made in any iteration of step 204 that a remote start request has been received, the process continues with the transmission of a state of charge request for a battery of the vehicle (step 206). In a preferred embodiment, the state of charge request is transmitted by the transmitter 112 of FIG. 1 to the vehicle 103 of FIG. 1 based at least in part upon instructions provided to the transmitter 112 by the processor 120 of FIG. 1. Also in a preferred embodiment, the state of charge request is received by the vehicle receiver 130 of FIG. 1.

A state of charge response signal, if any, is then received (step 208). The state of charge response signal is sent by the vehicle 103 in response to the state of charge request of step 206, and includes information pertaining to a state of charge of a battery of the vehicle. In a preferred embodiment, the state of charge response signal is transmitted by the vehicle transmitter 132 of FIG. 1 and is received by the receiver 114 of FIG. 1, and signals and/or other information pertaining thereto are then provided by the receiver 114 to the processor 120 of FIG. 1 for processing.

A determination is made as to whether any such state of charge response signals have been received (step 210). In a preferred embodiment, this determination is made by the processor 120 of FIG. 1 based upon the signals or other information, or lack thereof, provided thereto by the receiver 114 of FIG. 1.

If it is determined that a state of charge response signal has not been received, then a first notification is displayed (step 212). The first notification informs the user of the vehicle that a response signal was not received from the vehicle. The user then has the opportunity to move closer to the vehicle and try a remote start again, to use alternative means to start the vehicle such as by jump-starting the battery, or to have the vehicle inspected and/or the battery replaced. In a preferred embodiment, the first notification is provided by the display 115 of FIG. 1 based at least in part upon instructions provided thereto by the processor 120 of FIG. 1.

If it is determined that a state of charge response signal has been received, then an assessment is made as to a state of charge of the vehicle battery (step 214). In a preferred embodiment, this assessment is made by the processor 120 of FIG. 1 based at least in part upon signals or other information provided thereto by the receiver 114 of FIG. 1 pertaining to the state of charge response received in step 208. To assess the state of charge of the vehicle battery, a determination is preferably made as to whether the state of charge of the vehicle battery is greater than a first predetermined threshold value (step 216). This determination is also preferably made by the processor 120, based upon the state of charge determined in step 210. In a preferred embodiment, the predetermined threshold value is stored in the memory 122 of FIG. 1 and is retrieved therefrom by the processor 120 for this comparison. If it is determined that the state of charge of the vehicle battery is greater than the predetermined threshold value, then a conventional engine remote start request is provided (step 218). Otherwise, the process skips to step 228, described further below.

In an exemplary embodiment, the conventional engine remote start request of step 218 comprises transmission of a first group of engine start signals. Each of the engine start signals of the first group of engine start signals preferably has a first power level, and the engine start signals of the first group of engine start signals are preferably transmitted at a first rate wherein a first time period passes between signal (for example, approximately X milliseconds apart). For example, in one preferred embodiment, a relatively smaller number of first engine start signals (for example, less than five, in one exemplary embodiment, as compared with more than thirty of the second engine start signals described below in connection with step 234) are transmitted approximately one hundred milliseconds apart in step 218. In a preferred embodiment, the engine start signals of the first group of engine start signals are transmitted by the transmitter 112 of FIG. 1 based upon instructions provided thereto by the processor 120 of FIG. 1. Also in a preferred embodiment, these engine start signals are received by the vehicle receiver 130 of FIG. 1.

The process continues with the receipt of an engine start status (step 220). The engine start status includes information as to whether the engine of the vehicle has successfully been started. In a preferred embodiment, the engine start status is transmitted by the vehicle transmitter 132 of FIG. 1 and is received by the receiver 114 of FIG. 1, and a signal or other information pertaining thereto is then provided to the processor 120 of FIG. 1 for processing. A determination is then made as to whether a successful engine start has occurred (step 222). In a preferred embodiment, this determination is made by the processor 120 of FIG. 1 based upon the signal or other information provided thereto by the receiver 114 of FIG. 1 pertaining to the engine start status received in step 220.

If it is determined that a successful engine start has not occurred, then a third notification is displayed indicating that the engine did not start (step 224). The user then has the opportunity to move closer to the vehicle and try a remote start again, to use alternative means to start the vehicle such as by jump-starting the battery, or to have the vehicle inspected and/or the battery replaced. In a preferred embodiment, the third notification is provided for the user by the display 115 of FIG. 1 based at least in part upon instructions provided thereto by the processor 120 of FIG. 1.

If it is determined that a successful engine start has occurred, then a fourth notification is displayed indicating that the engine has successfully been started (step 226). In a preferred embodiment, the fourth notification is provided to the user by the display 115 of FIG. 1 based at least in part upon instructions provided thereto by the processor 120 of FIG. 1.

Returning now to step 216, if it is determined that the state of charge is less than or equal to the first predetermined threshold value, then an assessment is made as to an RF strength of the state of charge response signal received in step 210 (step 228). In a preferred embodiment, this assessment is made by the processor 120 of FIG. 1.

To assess the strength of the state of charge response signal, a determination is made as to whether the RF signal strength of the state of charge response signal is greater than a predetermined threshold value (step 230). This determination is preferably made by the processor 120, based upon the state of charge determined in step 210. In a preferred embodiment, the second predetermined threshold value is stored in the memory 122 of FIG. 1 and is retrieved therefrom by the processor 120 for this comparison.

If it is determined that the strength of the state of charge response signal is less than or equal to the second predetermined threshold value, then a second notification is displayed (step 232). The second notification requests that the user move closer to the vehicle. In a preferred embodiment, the second notification is displayed for the user by the display 115 of FIG. 1, based at least in part upon instructions provided thereto by the processor 120 of FIG. 1.

If it is determined instead that the strength of the state of charge response signal is greater than the second predetermined threshold value, then an alternative engine remote start request is provided (step 234). In a preferred embodiment, the alternative engine remote start request of step 234 comprises transmission of a second group of engine start signals. Each of the second group of engine start signals preferably has a second power level that is less than the first power level of the first group of engine start signals of step 218, and the engine start signals of the second group of engine start signals are transmitted at a second rate, wherein a second time period less than the first time period passes between each signal. The engine start signals of the second group of engine start signals are preferably transmitted approximately Y milliseconds apart, with Y being less than X, and the second rate thereby being faster than the first rate. For example, in one preferred embodiment, a relatively large number of second engine start signals (for example, greater than thirty, in one exemplary embodiment, as compared with less than five first engine start signals described above in connection with step 218) are transmitted approximately thirty milliseconds apart in step 234. In a preferred embodiment, the engine start signals of the second group of engine start signals are transmitted by the transmitter 112 of FIG. 1 based upon instructions provided thereto by the processor 120 of FIG. 1. Also in a preferred embodiment, these engine start signals are received by the vehicle receiver 130 of FIG. 1.

In accordance with an exemplary embodiment, the engine start signals of the second group of engine start signals are spaced close enough apart so that the vehicle receives one of the engine start signals of the second group of engine start signals shortly after the body control module (BCM) of the vehicle awakens after re-setting from a previous engine start attempt. For example, if the battery of the vehicle has a low state of charge, the BCM is likely to reset multiple times as initial engine start signals of the second group of engine start signals are received and the engine begins to turn and start, thereby resulting in a drop in the state of charge of the vehicle battery and a consequent reset of the BCM. However, due to the close spacing of the second group of engine start signals, the engine is still turning as subsequent engine start signals of the second group of engine start signals are received by the vehicle.

This preferably continues with additional subsequent engine start signals of the second group of engine start signals until eventually the engine is turning with enough rotation such that the engine does not need to overcome the static coefficient of friction and inertia of the engine. The voltage drop of the battery is thus minimized, the BCM does not reset again, and the engine continues to turn and is fully started. In addition, because each of the second group of engine start signals has a reduced power compared with the engine start signals of the first group of engine start signals, this allows for easier compliance with Federal Communication Commission (FCC regulations) that limit the amount of power provided by such control devices even with the increased number of engine start signals of the second group of engine start signals. Moreover, this provides an alternative means for starting the engine in cases in which a traditional manual engine start with an ignition key may not effectuate an engine start due to a low battery charge and additional accessory loads which are typically present.

The process then continues to the above-mentioned steps 220 and 222, in which an engine start status is received (step 220) and a determination is made as to whether a successful engine start has occurred (step 222). As mentioned above, in a preferred embodiment, the engine start status is received by the receiver 114 of FIG. 1, a signal or other information pertaining thereto is provided to the processor 120 of FIG. 1 for processing, and the determination as to whether a successful engine start has occurred is made by the processor 120 of FIG. 1 based at least in part thereon.

If it is determined that a successful engine start has not occurred, then the process continues to the above-mentioned step 224, in which a third notification is displayed indicating that the engine did not start. Otherwise, if it is determined that a successful engine start has occurred, then the process continues instead to the above-mentioned step 226, in which a fourth notification is displayed indicating that the engine has successfully been started. In a preferred embodiment, the third notification or the fourth notification, depending upon the determination made in step 222, is provided to the user by the display 115 of FIG. 1 based at least in part upon instructions provided thereto by the processor 120 of FIG. 1.

Accordingly, the process 200 utilizes feedback from the vehicle to tailor the engine start signals transmitted to the vehicle based upon the state of charge of the vehicle battery of the vehicle. If the battery has a sufficiently high state of charge (i.e., if the state of charge is greater than the first predetermined threshold value as determined in step 216), then a relatively smaller number of powerful and relatively spaced-apart first engine start signals are sent to the vehicle in step 218. Otherwise, if the battery has a relatively lower state of charge (i.e., if the state of charge is less than or equal to the first predetermined threshold value as determined in step 216), then the process provides instead for the transmission of a relatively larger number of less powerful but more rapidly transmitted second engine start signals to be sent to the vehicle in step 234. In addition, the process provides notifications to the user of the vehicle so that the user can take appropriate action when any of the following occur: (i) a response is not received from the vehicle (step 212), (ii) the user is too far from the vehicle to effectively start the engine remotely (step 232), (iii) the remote starting of the engine is not successful (step 224), and (iv) the remote starting of the engine is successful (step 226).

It will be appreciated that certain steps of the process 200 may differ from and/or may be performed simultaneously or in a different order than those depicted in FIG. 1 and described herein. For example, in certain embodiments, some or all of the various notifications to the user may be unnecessary and/or may be modified. As another example, the determinations in step 214 and step 228 may occur in a different order in certain embodiments, among other possible variations to the steps of the process 200 of FIG. 2.

Accordingly, improved methods, program products, and systems are provided for remotely starting an engine of a vehicle. The improved methods, program products, and systems allow for improved starting of vehicle engines with engine start requests that are tailored to a state of charge of a battery of the vehicle. The improved methods, program products, and systems provide such improved remote starting of an engine of the vehicle while complying with FCC regulations. In addition, the improved methods, program products, and systems provide an alternative means for starting an engine of a vehicle in situations in which a traditional engine start with an ignition key would be more difficult due to a low state of charge of a battery of the vehicle. Also, in certain embodiments, the improved methods, program products and systems provide notifications to a user of the vehicle, for example as to the status of the engine remote start and when to move closer to the vehicle to improve the probability that the remote start will be successful.

It will be appreciated that, in various embodiments, the disclosed methods, program products, and systems may vary from those depicted in the figures and described herein. It will similarly be appreciated that, while the disclosed methods, program products, and systems are described above as being used in connection with automobiles such as sedans, trucks, vans, and sports utility vehicles, the disclosed methods, program products, and systems may also used in connection with any number of different types of vehicles, and in connection with any number of different systems thereof and environments pertaining thereto.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing the exemplary embodiment or exemplary embodiments. It should be understood that various changes can be made in the function and arrangement of elements without departing from the scope of the invention as set forth in the appended claims and the legal equivalents thereof.

What is claimed is:

1. A method for remotely starting an engine of a vehicle, the vehicle including a battery, and the method comprising the steps of:

assessing a state of charge of the battery;

providing a first type of remote start request to the vehicle if the state of charge of the battery is greater than a first predetermined threshold; and providing a second type of remote start request to the vehicle if the state of charge of the battery is less than or equal to the first predetermined threshold.

2. The method of claim 1, wherein:

the step of providing the first type of remote start request comprises the step of transmitting a first plurality of engine start signals to the vehicle, each of the first plurality of engine start signals having a first power level, if the state of charge of the battery is greater than the first predetermined threshold; and the step of providing the second type of remote start request comprises the step of transmitting a second plurality of engine start signals to the vehicle, each of the second plurality of engine start signals having a second power level that is less than first power level, if the state of charge of the battery is less than the predetermined threshold.

3. The method of claim 2, wherein the step of assessing the state of charge of the battery comprises the steps of:

transmitting a state of charge request signal to the vehicle; and receiving a state of charge response signal.

4. The method of claim 3, further comprising the step of:

determining a measure of strength of the state of charge response signal;

wherein the step of transmitting the second plurality of engine start signals comprises the step of transmitting the second plurality of engine start signals to the vehicle if the measure of strength of the state of charge response signal is greater than a second predetermined threshold.

5. The method of claim 2, wherein:

the step of transmitting the first plurality of engine start signals comprises the step of transmitting the engine start signals of the first plurality of engine start signals approximately a first time period apart; and the step of transmitting the second plurality of engine start signals comprises the step of transmitting the engine start signals of the second plurality of engine start signals approximately a second time period apart, wherein the second time period is less than the first time period.

6. The method of claim 2, wherein the step of assessing the state of charge of the battery comprises the step of transmitting a state of charge request signal to the vehicle, and the method further comprises the step of:

displaying a first notification of a lack of response from the vehicle if no state of charge response signal is detected.

7. The method of claim 6, further comprising the step of:

displaying a second notification to move closer to the vehicle if a strength of a state of charge response signal is less than or equal to a second predetermined threshold.

8. A program product for remotely starting an engine of a vehicle having a battery, the program product comprising:

(a) a program configured to at least facilitate:

assessing a state of charge of the battery;

providing a first type of remote start request to the vehicle if the state of charge of the battery is greater than a first predetermined threshold; and providing a second type of remote start request to the vehicle if the state of charge of the battery is less than or equal to the first predetermined threshold; and (b) a computer-readable signal bearing media bearing the program.

9. The program product of claim 8, wherein the program is configured to at least facilitate:

transmitting a first plurality of engine start signals to the vehicle, each of the first plurality of engine start signals having a first power level, if the state of charge of the battery is greater than the first predetermined threshold; and transmitting a second plurality of engine start signals to the vehicle, each of the second plurality of engine start signals having a second power level that is less than first power level, if the state of charge of the battery is less than or equal to the first predetermined threshold.

10. The program product of claim 9, wherein the program is further configured to at least facilitate:

transmitting a state of charge request signal to the vehicle; and receiving a state of charge response signal.

11. The program product of claim 10, wherein the program is further configured to at least facilitate:

determining a measure of strength of the state of charge response signal; and transmitting the second plurality of engine start signals to the vehicle if the measure of strength of the state of charge response signal is greater than a second predetermined threshold.

12. The program product of claim 9, wherein the program is configured to at least facilitate:

transmitting the engine start signals of the first plurality of engine start signals approximately X milliseconds apart; and transmitting the engine start signals of the second plurality of engine start signals approximately Y milliseconds apart, Y being less than X.

13. The program product of claim 9, wherein the program is further configured to at least facilitate displaying a first notification of a lack of response from the vehicle if no state of charge response signal is detected.

14. The program product of claim 13, wherein the program is further configured to at least facilitate displaying a second notification to move closer to the vehicle if a measure of strength of a state of charge response signal is less than or equal to a second predetermined threshold.

15. A system for remotely starting an engine of a vehicle having a battery, the system comprising:

a processor configured to at least facilitate assessing a state of charge of the battery; and a transmitter coupled to the processor and configured to at least facilitate:

providing a first type of remote start request to the vehicle if the state of charge of the battery is greater than a first predetermined threshold; and providing a second type of remote start request to the vehicle if the state of charge of the battery is less than or equal to the first predetermined threshold.

16. The system of claim 15, wherein the transmitter is configured to at least facilitate:

transmitting a first plurality of engine start signals to the vehicle, each of the first plurality of engine start signals having a first power level, if the state of charge of the battery is greater than the first predetermined threshold; and transmitting a second plurality of engine start signals to the vehicle, each of the second plurality of engine start signals having a second power level that is less than first power level, if the state of charge of the battery is less than or equal to the first predetermined threshold.

17. The system of claim 16, further comprising:

a receiver coupled to the processor;

wherein:

the transmitter is configured to at least facilitate transmitting a state of charge request signal to the vehicle;

the receiver is configured to at least facilitate receiving a state of charge response signal from the vehicle in response to the state of charge request;

the processor is configured to at least facilitate determining a measure of strength of the state of charge response signal; and the transmitter is configured to at least facilitate transmitting the second plurality of engine start signals to the vehicle if the measure of strength of the state of charge response signal is greater than a second predetermined threshold.

18. The system of claim 17, further comprising:

a display coupled to the processor, the display configured to at least facilitate displaying a first notification of a lack of response from the vehicle if no state of charge response signal is detected.

19. The system of claim 18, wherein the display is further configured to at least facilitate displaying a second notification to move closer to the vehicle if the measure of strength of the state of charge response signal is less than or equal to the second predetermined threshold.

20. The system of claim 16, wherein the transmitter is configured to at least facilitate:

transmitting the engine start signals of the first plurality of engine start signals approximately X milliseconds apart; and transmitting the engine start signals of the second plurality of engine start signals approximately Y milliseconds apart, Y being less than X.

* * * * *